United States Patent [19]

Creech

[11] 4,218,602

[45] Aug. 19, 1980

[54] SEALED ELECTRIC SWITCH

[75] Inventor: Herman I. Creech, Smithfield, N.C.

[73] Assignee: Eaton Corporation, Cleveland, Ohio

[21] Appl. No.: 18,282

[22] Filed: Mar. 6, 1979

[51] Int. Cl.[2] ..... H01H 9/04

[52] U.S. Cl. ..... 200/302

[58] Field of Search ..... 200/302, 333, 339

[56] References Cited

U.S. PATENT DOCUMENTS

| | | | |
|---|---|---|---|
| 2,633,510 | 3/1953 | Schellman | 200/302 |
| 2,786,359 | 3/1957 | Karlan et al. | 200/302 |
| 3,483,345 | 12/1969 | Hults | 200/302 |

*Primary Examiner*—Stephen Marcus

*Attorney, Agent, or Firm*—H. R. Rather; W. A. Autio; R. J. McCloskey

[57] ABSTRACT

A one-piece seal for an electric switch for sealing the spaces between a pivotal switch actuator and its supporting frame and between such frame and the switch base. This seal comprises a generally rectangular molded member of resilient material having a bushing extending up into sealing engagement with the pivotal area of the actuator, a land on its upper surface locating and retaining the seal with respect to the aperture in the switch frame, a pair of lugs or pads on its bottom surface for locating and retaining the seal with respect to the switch base, a radius on each of the outwardly facing bights between these lugs and the planar bottom surface of the seal into which the sharp corners of the base bite to effect a tight seal, and thinner sections formed by recesses on opposite sides of the aforesaid land for receiving complementary shelf portions of the frame in combination with thicker side strips or ribs that are pinched between the frame and base for a tight seal. The seal is pinched between the frame and base and hugs the actuator around its pivot pin area to provide an economical but effective seal.

12 Claims, 6 Drawing Figures

SEALED ELECTRIC SWITCH

BACKGROUND OF THE INVENTION

Seals for electric switches have been known heretofore. However, these prior seals have generally been of the multi-part type, molded-in-situ type or formed-in-place type or the like, or have required an additional retaining part or parts to hold them in place. While these prior seals have been useful for their intended purposes, this invention relates to improvements thereover.

SUMMARY OF THE INVENTION

An object of the invention is to provide an improved seal for an electric switch.

A more specific object of the invention is to provide an improved one-piece seal for a pivotal acutator switch.

Another specific object of the invention is to provide an improved one-piece preformed seal for a pivotal actuator switch that is easy to assemble.

Another specific object of the invention is to provide an improved one-piece seal for a pivotal actuator switch that incorporates a bushing gripping the pivotal actuator at its pivotal area.

Another specific object of the invention is to provide an improved one-piece seal for a pivotal actuator switch that includes improved means for sealing the spaces between the actuator and its supporting frame and between the frame and the switch base and for locating the seal with respect to the frame and base.

Other objects and advantages of the invention will hereinafter appear.

DESCRIPTION OF THE PREFERRED EMBODIMENT

Figure 1:
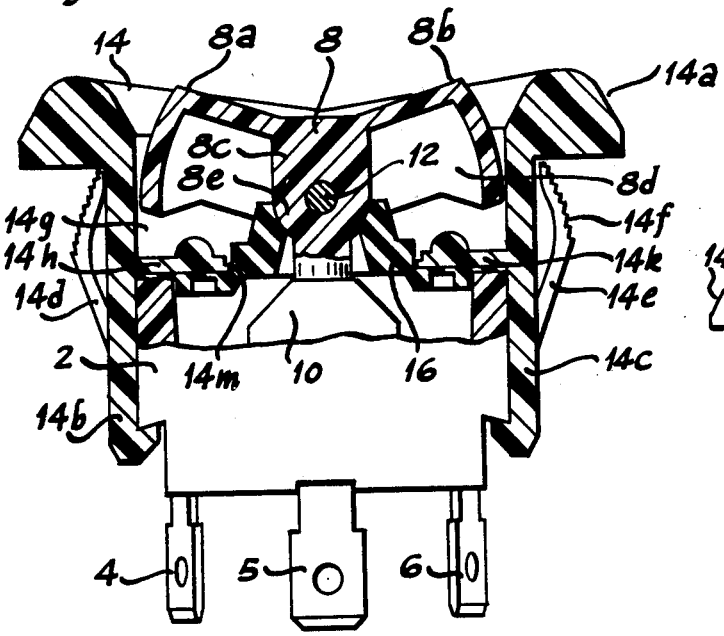
FIG. 1 is an enlarged longitudinal, vertical cross-sectional view of a pivotal actuator switch constructed in accordance with the invention and showing the actuator in its center off position with the seal gripping it at its pivotal area.

Referring to FIG. 1, there is shown a sealed electric switch constructed in accordance with the invention. As shown therein, this switch is provided with a switch housing comprising an insulating, molded base 2 for housing the double-pole switch contacts, each set of which may be generally similar to that shown in M. F. Koenig U.S. Pat. No. 2,726,105, dated Dec. 6, 1955, and assigned to the assignee of this invention. The bottom of this base is provided with a plurality of holes through which rivets extend that connect the stationary contacts within the base to external terminals 4, 5 and 6, there being three terminals and respective stationary contacts if the switch is a single-pole double-throw switch as shown in the aforementioned Koenig patent, or six terminals and associated stationary contacts if it is a double-pole double-throw switch as shown herein. Center terminal 5 is common and may be connected by a rockable movable contact to either terminal 4 or 6 when actuator 8 is pivotally operated.

Actuator 8 is shown as being of the rocker type although other forms of pivotal actuators such as toggle lever, paddle lever, or the like may be used. This rocker type pivotal actuator has upwardly inclined opposite portions **8*a* and 8*b* that may be alternately pressed to close the respective poles of the switch. This rocker actuator is also provided with an actuating stem 8*c* having a reduced diameter end portion that extends down into a hole in an actuator block 10. Such actuator block is used in double-pole switches to span the two spaced apart movable contacts. This rocker actuator is pivotally supported by a pivot pin 12 extending through holes in side skirts 8*d* and stem 8*c* and aligned holes in the side walls of a frame 14** of the switch housing.

This frame 14, which may be metal or insulating plastic, supports the pivotal actuator, closes the top of the base and clamps a sealing member 16 between the top of the base and the frame as shown in FIG. 1. This frame is provided with a suitable bezel or escutcheon **14*a* of generally rectangular shape in top view that will overlie the margin of a hole in a mounting plate in which the switch is installed in use. Frame 14 is also provided with a pair of snap-in legs 14*b* and 14*c*, one at each end of the frame, and having hooks at their lower ends for snap-in attachment in notches near the lower corners at the ends of the base. Two pairs of spaced-apart snap-in arms, one arm 14*d* and 14*e* of each such pair being shown in FIG. 1, extend upwardly from the lower ends of the respective legs and have suitable curvature and serrations for snap-in mounting of the switch in a rectangular hole in a mounting panel. The serrations 14*f*** on the upper end portion of these arms afford mounting on panels of different thicknesses.

Figure 6:
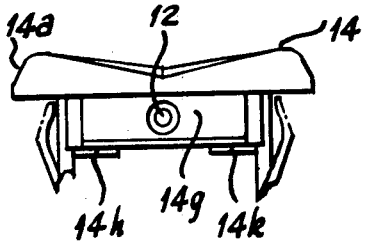
FIG. 6 is a partial front-side elevational view of the frame used in the switch of FIG. 1.

This frame which is plastic as shown is provided with a skirt **14*g* having end walls that are continuous with the side walls as shown in FIGS. 1 and 6 with pivot pin 12 extending centrally through the holes in the two side walls. A pair of shelves 14*h* and 14*k* extend horizontally inwardly from the lower edges of the end walls of the skirt, each such shelf being integral and continuous with the corresponding portions of the side walls of the skirt. These shelves have a thickness such that their lower surfaces are slightly below the lower edges of the walls of the skirt as shown in FIG. 6**, thus to provide space below the lower edges of the side walls, or grooves therealong, for the ribs of the preformed seal hereinafter described.

Figure 2:
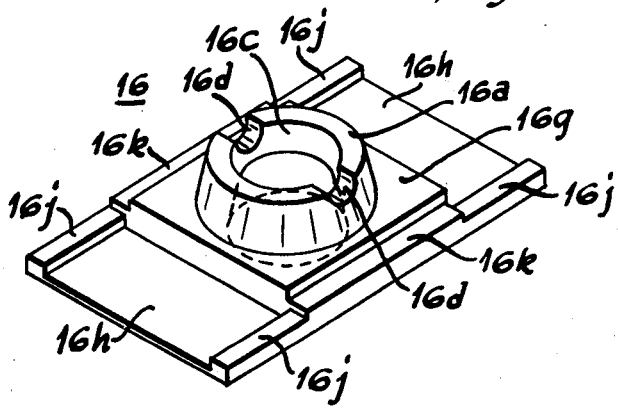
FIG. 2 is an isometric view of the top of the one-piece seal used in the switch of FIG. 1.
Figure 4:
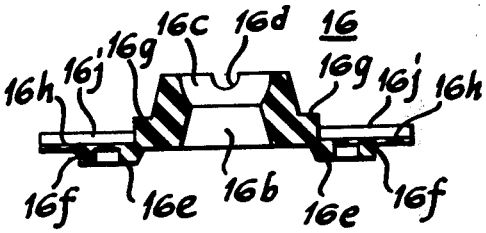
FIG. 4 is a longitudinal cross-sectional view of the one-piece seal of FIGS. 2 and 3 showing the radius at each of the outwardly facing bights between the bottom lugs and the planar bottom surface.
Figure 3:
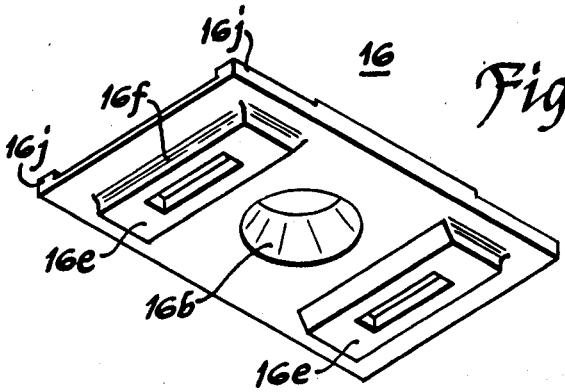
FIG. 3 is an isometric view of the bottom of the one-piece seal of FIG. 2.

Seal 16 is made in one piece for ease of assembly and is provided with a configuration affording tight and efficient sealing of the interior of the switch base from the outside, thus to prevent entry of dirt thereinto. For this purpose, seal 16 is a rectangular member generally flat but having an upstanding bushing **16*a* surrounding a round hole at its center as shown in FIGS. 2–5. Bushing 16*a* is tapered or frusto-conical in external shape as is the lower portion 16*b* of the hole therein as shown in FIGS. 3 and 4. The upper portion 16*c* of this hole has an outwardly curved, concave surface similar to a slice or segment taken from one side adjacent the center of a sphere. This surface 16*c* is complementary to the convex or circular, partial spherical section 8e between the thick upper portion of actuator stem 8c and its thinner intermediate portion as shown in FIG. 1. The upper edge of bushing 16a has a pair of semi-cylindrical, lateral grooves 16d on opposite sides of the bushing in alignment with one another to receive the portions of the actuator pivot pin between the actuator stem and side skirts 8d** of the actuator. This allows the bushing to be made long enough to extend into the pivot pin area or pivotal area of the actuator where the relative motion between the actuator and the seal is minimum thereby to maintain a better sealing effect than would be the case if there were a large amount of rubbing motion therebetween.

Figure 5:
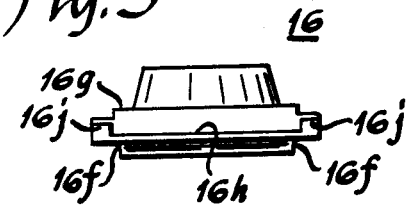
FIG. 5 is an end view of the one-piece seal of FIGS. 2–4.

The lower surface of the sealing member includes means for locating and retaining the sealing member with respect to the base and for providing a tighter seal therebetween. This means comprises a pair of integral pads or lugs 16e on the bottom surface near the opposite ends of the sealing member, this bottom surface being otherwise planar, as shown in FIG. 3. These lugs are generally rectangular and spaced apart so that they are substantially complementary to the respective opposite end portions of the rectangular opening at the top of the base as shown in FIG. 1 thereby to locate and maintain this sealing member with respect to the base when the frame is snapped on. As shown in FIGS. 4 and 5, the three outwardly facing bights between each lug and the planar bottom surface of the sealing member are provided with a "radius" 16f. The sharp inner corners of the base bite into this radius, or rounded rather than right angle portion, for a tighter sealing effect.

The upper surface of the sealing member is provided with means for locating and retaining the same with respect to the frame and for providing a tighter seal therebetween. This means comprises a rectangular or almost square land 16g around bushing 16a formed by a thicker section as shown in FIGS. 2, 4 and 5. This land 16g is of a size complementary to aperture 14m between shelves 14h and 14k and side walls 14g of the frame. This land fits snugly into the aperture in the frame to locate and maintain the sealing member with respect to the frame when the frame is snapped on the base. This means also comprises recesses 16h in the upper surface between land 16g and the opposite ends of the sealing member for receiving the lower portions of shelves 14h and 14k of the frame as shown in FIGS. 1, 2 and 4–5. As will be apparent, these recesses 16h provide strips or ribs 16j laterally on opposite sides thereof of thicker section that will be retained securely and pinched between the lower edges of side walls 14g of the frame and the upper edges of the side walls of the base. At the same time, the thinner portions at the extreme ends of the sealing member below recesses 16h will be pinched between shelves 14h and 14k and the respective upper edges of the end walls of the base as shown in FIG. 1. To avoid any leakage into the base at the opposite sides of aperture 14m, connecting ribs 16k at the opposite lateral sides of land 16g that connect the sections of ribs 16j are slightly thicker than ribs 16j as shown in FIG. 2. Because there are no corresponding shelves to confine the seal ribs at this center area, this increased thickness of ribs 16k insures that a tight sealing effect is maintained.

To assemble the switch, the contacts and terminals are assembled in the base and the actuator is assembled in the frame by its pivot pin. Thereafter, the sealing member is inserted in the frame aperture surrounding the actuator stem. The actuator block is then placed over the movable contacts in the base. Finally, the actuator stem is inserted in the hole in the block and the frame subassembly is snapped onto the base subassembly to complete the switch.

While the apparatus hereinbefore described is effectively adapted to fulfill the objects stated, it is to be understood that this invention is not intended to be confined to the particular preferred embodiment of sealed electric switch disclosed, inasmuch as it is susceptible of various modifications without departing from the scope of the appended claims. For example, this seal with suitable dimensional changes could be used on a different size of switch housing.

I claim:

1. A sealed electric switch comprising:

a switch housing comprising an insulating open-top base and a frame having an actuator opening, said frame connected to said base to close the top thereof except for said actuator opening thereby to provide a contact compartment therewithin;

contact means in said compartment including stationary contacts and movable contact means operable to close and open with respect to said stationary contacts;

terminal means for connecting said stationary contacts to an external circuit;

an actuator and pivot means mounting said actuator to said frame and having a stem extending freely through said opening into said compartment for actuating said movable contact means when said actuator is pivotally operated; and a seal member for sealing said compartment from the outside comprising:

a preformed generally flat resilient member having its rim clamped between said frame and said base and having a hole therethrough and an upwardly and inwardly tapered bushing extending up from the rim of said hole for insertion onto said stem from below to grip at its upper reduced end said stem of said actuator in the area of said pivot means to provide a tight seal; and said stem comprises a convex portion and said upper end of said tapered bushing comprises a complementary concave portion maintaining tight sealing engagement with said convex portion during said pivotal operation of said actuator.

2. The sealed electric switch claimed in claim 1, wherein:

said convex portion comprises a circular, partial spherical portion and said upper end of said tapered bushing comprises said concave surrounding portion complementary thereto to maintain tight sealing engagement with said circular, partial spherical portion throughout said pivotal operation of said actuator.

3. The sealed electric switch claimed in claim 1, wherein:

said generally flat resilient member and said frame comprises interfitting means for locating and maintaining said seal member with respect to said frame.

4. The sealed electric switch claimed in claim 3, wherein:

said interfitting means comprises a land on said generally flat resilient member around the lower portion of said bushing fitting snugly into said actuator opening in said frame.

5. The sealed electric switch claimed in claim 3, wherein:

said interfitting means comprises ribs along opposite portions of said rim of said generally flat resilient member and complementary grooves along corresponding sides of said frame for retaining said ribs and pinching them against said base to provide a tight seal.

6. The sealed electric switch claimed in claim 1, wherein:

said generally flat resilient member and said base comprise interfitting means for locating and maintaining said seal member with respect to said base.

7. The sealed electric switch claimed in claim 6, wherein:

said interfitting means comprises said opening at the top of said base being rectangular and a pair of rectangular lugs on the lower surface of said generally flat resilient member fitting snugly into opposite end portions of said rectangular opening.

8. The sealed electric switch claimed in claim 7, wherein said interfitting means also comprises:

sharp inner corners on said rectangular opening at the top of said base; and a "radius" or rounded configuration on each of the outwardly facing bights between said rectangular lugs and said lower surface of said seal member into which said sharp corners bite to effect a tight seal.

9. The sealed electric switch claimed in claim 1, wherein:

said base, frame and seal member are rectangular in configuration;

said actuator opening in said frame is defined by opposite lateral side walls and shelves extending inwardly from the opposite end walls of said frame, said shelves extending also a small amount downwardly below the side walls of said frames; and said seal member is provided with recesses complementary to said downward extensions of said shelves to provide a pair of ribs on opposite lateral sides of each said recess to be pinched between the side walls and shelves of said frame and said base for effective sealing.

10. The sealed electric switch claimed in claim 9, wherein said seal member also comprises;

rim portions on opposite lateral sides of said seal member connecting corresponding aligned ribs of said pairs thereof and being slightly thicker than said ribs to be pinched between the side walls of said frame and said base to insure an effective seal adjacent said actuator opening.

11. The sealed electric switch claimed in claim 1, wherein:

said pivot means comprises a pivot pin extending through said frame and said actuator stem; and said bushing of said seal member comprises a pair of semi-cylindrical grooves on opposite sides of the upper end thereof affording extension of said bushing to engage said stem immediately adjacent the pivot point of said actuator for minimum relative motion therebetween when said actuator is pivotally operated.

12. The sealed electric switch claimed in claim 11, wherein;

the inner surface of said bushing and said hole in said seal member are frusto-conical flaring downwardly to provide clearance for pivotal movement of said actuator stem.

* * * * *